US008439532B2

(12) United States Patent
Bertram et al.

(10) Patent No.: US 8,439,532 B2
(45) Date of Patent: May 14, 2013

(54) LIGHTING DEVICE TO BE INSTALLED IN A PANEL

(75) Inventors: Ralph Bertram, Nittendorf (DE); Nico Morgenbrod, Berlin-Charlottenburg (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 69 days.

(21) Appl. No.: 12/583,407

(22) Filed: Aug. 20, 2009

(65) Prior Publication Data

US 2010/0053967 A1 Mar. 4, 2010

(30) Foreign Application Priority Data

Aug. 29, 2008 (DE) ..... 10 2008 044 956

(51) Int. Cl.
*F21V 29/00* (2006.01)
*F21S 8/02* (2006.01)

(52) U.S. Cl.
USPC ..... 362/373; 362/147; 362/365; 362/96

(58) Field of Classification Search ..... 362/147, 362/148, 373, 249.02, 96, 294, 365
See application file for complete search history.

(56) References Cited

U.S. PATENT DOCUMENTS

| | | | | |
|---|---|---|---|---|
| 5,934,783 | A * | 8/1999 | Yoshikawa | 362/96 |
| 6,095,671 | A * | 8/2000 | Hutain | 362/373 |
| 7,301,346 | B2 * | 11/2007 | Annighoefer et al. | 324/414 |
| 7,607,935 | B2 * | 10/2009 | Dahl | 439/485 |
| 7,614,769 | B2 * | 11/2009 | Sell | 362/365 |
| 7,677,770 | B2 | 3/2010 | Mazzochette | |
| 2004/0208009 | A1 * | 10/2004 | Mardon et al. | 362/373 |
| 2006/0104066 | A1 * | 5/2006 | Cini et al. | 362/373 |
| 2006/0262544 | A1 * | 11/2006 | Piepgras et al. | 362/373 |
| 2008/0165535 | A1 | 7/2008 | Mazzochette | |
| 2008/0212333 | A1 * | 9/2008 | Chen | 362/373 |
| 2010/0039829 | A1 * | 2/2010 | Tsai | 362/373 |
| 2010/0091500 | A1 * | 4/2010 | Herbst | 362/294 |

FOREIGN PATENT DOCUMENTS

| | | | |
|---|---|---|---|
| DE | 3136222 | A1 | 9/1981 |
| DE | 102007 019 074 | A1 | 4/2007 |
| DE | 102007019074 | A1 | 4/2007 |

* cited by examiner

*Primary Examiner* — Peggy A. Neils

(74) *Attorney, Agent, or Firm* — Holtz, Holtz, Goodman & Chick, P.C.

(57) ABSTRACT

The invention relates to a lighting device to be installed in and/or behind a panel (3), in particular ceiling and/or wall cladding, comprising at least one fitted lamp (1, 1*a*, 1*b*) having at least one housing (4) which ends approximately flush with the panel (3), at least one light exit surface (10) and at least one LED module (10), the LED module (5) comprising at least one light-emitting diode (LED) (6). At least one ventilation opening (11, 12) is arranged between the light exit surface (10) and the housing (4) and means (13) are provided for generating an air flow through the ventilation opening (11, 12).

5 Claims, 4 Drawing Sheets

LIGHTING DEVICE TO BE INSTALLED IN A PANEL

TECHNICAL FIELD

The invention relates to a lighting device to be installed in and/or behind a panel, in particular ceiling and/or wall cladding, comprising at least one fitted lamp having at least one housing which ends approximately flush with the panel, at least one light exit surface and at least one LED module, the LED module comprising at least one light-emitting diode (LED).

PRIOR ART

Many places and applications require lighting without the lamps being visible, or for which the lamps should not or must not protrude into the room to be illuminated, for example in order to prevent them from being damaged or not to interrupt the visual appearance of a smooth surface. Such requirements are ideally satisfied by using fitted lamps, these being placed for example in a wall or ceiling or in the floor in such a way that they protrude only insubstantially from the surface in which they are installed.

For ceiling lighting, it is conventional to fit a panel below the actual supporting ceiling, the panel having recesses in which the fitted lamps are arranged. The fitted lamps may for example be connected directly to an electricity supply, so that the lighting device consists only of the fitted lamp per se, or further components may be provided, in particular a ballast separate from the fitted lamps, and in the simplest case only a transformer, which are then also part of the lighting device.

A common feature of all fitted lamps is that they should have the smallest possible installation space. In this way, in particular, the distance between a cladding panel and the structure lying behind it can be kept as small as possible. With a decreasing installation space, however, it is also more difficult to dissipate the heat produced during operation of the lighting device. This applies in particular to lighting devices having light-emitting diodes (LEDs) as their light source, since on the one hand these respond very sensitively to high temperatures and on the other hand heat cannot be released by radiation, but essentially only through heat sinks arranged on their rear side. With a restricted installation space, however, the size of the heat sinks is also limited, and when fitted lamps are installed in a cladding panel the convection in the cavity lying behind it is often insufficient to ensure effective dissipation of heat.

In order to avoid overheating of the LED, circuits are therefore often provided which reduce the power of the LED when a predetermined temperature is exceeded.

SUMMARY OF THE INVENTION

It is therefore an object of the present invention to provide a lighting device to be installed in and/or behind a panel, in particular ceiling and/or wall cladding, comprising at least one fitted lamp having at least one housing which ends approximately flush with the panel, at least one light exit surface and at least one LED module, the LED module comprising at least one light-emitting diode (LED), which allows good dissipation of heat with a compact design.

This object is achieved by the characterizing features of claim 1.

Particularly advantageous configurations may be found in the dependent claims.

Arranging at least one ventilation opening between the light exit surface and the housing, and providing means for generating an air flow through the ventilation opening, ensure that a sufficient amount of air travels past the light exit surface to reach the lighting device's parts lying behind it, and therefore in particular the LED module and a heat sink optionally connected to it, and that this air can be extracted therefrom. These components can therefore be cooled effectively, without parts of the lighting device protruding from the panel.

It is expedient for the light exit surface to be essentially encircled fully by one or more ventilation openings, since a relatively large cross section is thereby provided for the ventilation opening, without this being too visually conspicuous and therefore interfering with an overall appearance of the fitted lamp which is important for many applications. It also ensures particularly good flow of cooling air through the fitted lamp.

In one advantageous refinement of the invention, the ventilation opening is actively connected to a device for delivering air to and/or extracting air from the room to be illuminated. The air flow through the ventilation opening can therefore be provided at least partially by means of the device for delivering air to and/or extracting air from the room to be illuminated, which simplifies the construction of the lighting device since a device, integrated in the lighting device, for generating the air flow can be obviated or at least made smaller and therefore simpler.

In another advantageous refinement of the invention, the means for generating an air flow comprise at least one preferably electrically operated fan. The air flow can therefore be generated particularly simply, and its strength and direction can also be controlled. Electric fans, in particular, are very suitable since an electricity supply is already required for operating the LED module and may therefore advantageously be used to supply the electric fan as well. The fan may expediently be arranged between an air inlet opening and an air outlet opening.

A particularly simple construction is achieved by arranging the fan inside the housing of the fitted lamp. On the one hand this allows the fan to be externally shielded so that it is protected against environmental effects, and on the other hand it allows simple routing of the air flow. With a suitable configuration of the housing, it also ensures good noise insulation.

In another embodiment of the invention, the fan is arranged outside the housing of the fitted lamp. This is advantageous in particular when the air flow is intended to be extracted from the fitted lamp or fed into it from the outside. More space is usually available outside the housing than inside it, and the transmission of noise into the room to be illuminated can be prevented more effectively. Furthermore, if it is installed in a suitable way, it is much easier to replace the fan which usually suffers the greatest wear out of all the components of the lighting device, than if it is installed inside the fitted lamp.

It is expedient for the fitted lamp to have at least two ventilation openings, of which at least one is designed as an air inlet opening and at least one is designed as an air outlet opening. This makes it possible to ensure a defined air flow inside the fitted lamp, and no other air flows are required outside the fitted lamp. For this, the openings should expediently have approximately the same cross section in order to ensure maximally unimpeded and uniform flow through the fitted lamp.

Designing the fan as a device for holding the LED module will achieve a particularly simple and compact structure in mechanical terms, in which it is possible both to have short electrical connection leads and to route the air advantageously.

In a particularly advantageous configuration of the invention the lighting device has at least two fitted lamps, at least one ventilation opening being designed as an air inlet opening for at least one first fitted lamp and at least one ventilation opening being designed as an air outlet opening for at least one second fitted lamp, and the air inlet opening of the first fitted lamp being actively connected to the air outlet opening of the second fitted lamp. In this construction, the air required for cooling is sucked in through one fitted lamp and ejected again through the other, so that improved flow conditions are created since a uniform flow direction can be set up inside the fitted lamp and flow reversal is not required there.

Expediently, the fan is in this case arranged outside the fitted lamps, which offers optimal noise insulation as well as a simple way of replacing the fan. Furthermore, there is more space for a powerful fan between the cladding panel and the building structure than in the fitted lamps per se.

If the first fitted lamp is connected to the second fitted lamp by means of at least one ventilation duct, expedient routing of the air flow can be achieved and the effectiveness of routing the air can therefore be increased.

In this case, it is particularly advantageous for the fan to be arranged in the at least one ventilation duct, since much more installation space is available there than in one of the fitted lamps, and better shielding of the running noise is possible.

It is furthermore advantageous for the ventilation opening to have at least one cover. This will prevent foreign bodies from entering the ventilation opening. Furthermore, with a cover the ventilation opening becomes much less conspicuous and therefore interferes much less with the overall look of the lighting device.

Advantageously, the cover is designed as a device for holding the LED module. A particularly simple arrangement can be achieved in this way, in which independent mounting of the LED module can be obviated.

It is expedient for the housing of the fitted lamp to be designed in the shape of a bell, since on the one hand a space-saving arrangement is thereby achieved and on the other hand the air can be routed advantageously without the flow being hindered by corners and edges. Here, it is also advantageous for the housing to have thermal insulation, either by making it per se from a low thermal conduction material, for example a polymer material, in particular PP, PA, ABS or the like, or by providing it with a thermally insulating layer. The term low thermal conduction or thermally insulating in this case refers to materials or layers having a thermal conductivity of less than 0.5 J/(mK), in particular less than 0.2 J/(mK).

BRIEF DESCRIPTION OF THE DRAWINGS

The invention will be explained in more detail below with the aid of exemplary embodiments. In the figures.

PREFERRED EMBODIMENTS OF THE INVENTION

Figure 1:
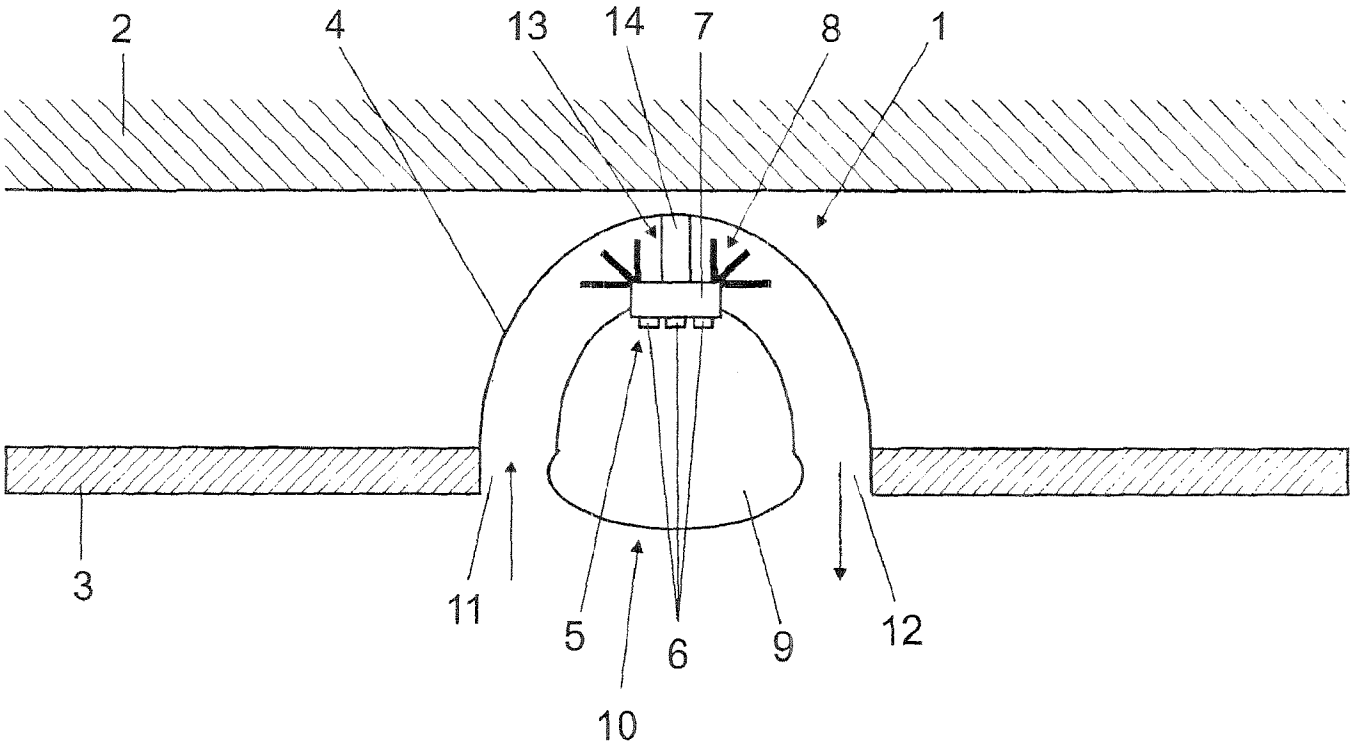
FIG. 1 shows an exemplary embodiment of a lighting device according to the invention with one fitted lamp, represented in a sectional view.

FIG. 1 shows a lighting device according to the invention with one fitted lamp 1, represented in a lateral sectional view. The fitted lamp 1 is used for ceiling lighting; a cladding panel 3, in which the fitted lamp 1 is installed, is installed below the actual ceiling 2.

The fitted lamp 1 consists essentially of a housing 4, in which there is an LED module 5. In the exemplary embodiment shown, in addition to differently colored LEDs 6 which are arranged together with a driver circuit (not shown) on a support 7, the LED module 5 also comprises a heat sink 8 and an optics unit 9, which is used for beam guidance of the emitted light and has a light exit surface 10.

Between the housing 4 and the light exit surface 10 of the optics unit 9, there are two ventilation openings 11, 12, of which one is provided as an air inlet opening 11 and one as an air outlet opening 12. In order to ensure the air flow from the air inlet opening 11 to the LED module 5, and there in particular to the heat sink 8 and to the air outlet opening 12, an electrically operated fan 13 is arranged between the housing 4 and the LED module 5. The fan housing 14 is also used as a mounting for the LED module 5.

Figure 2:
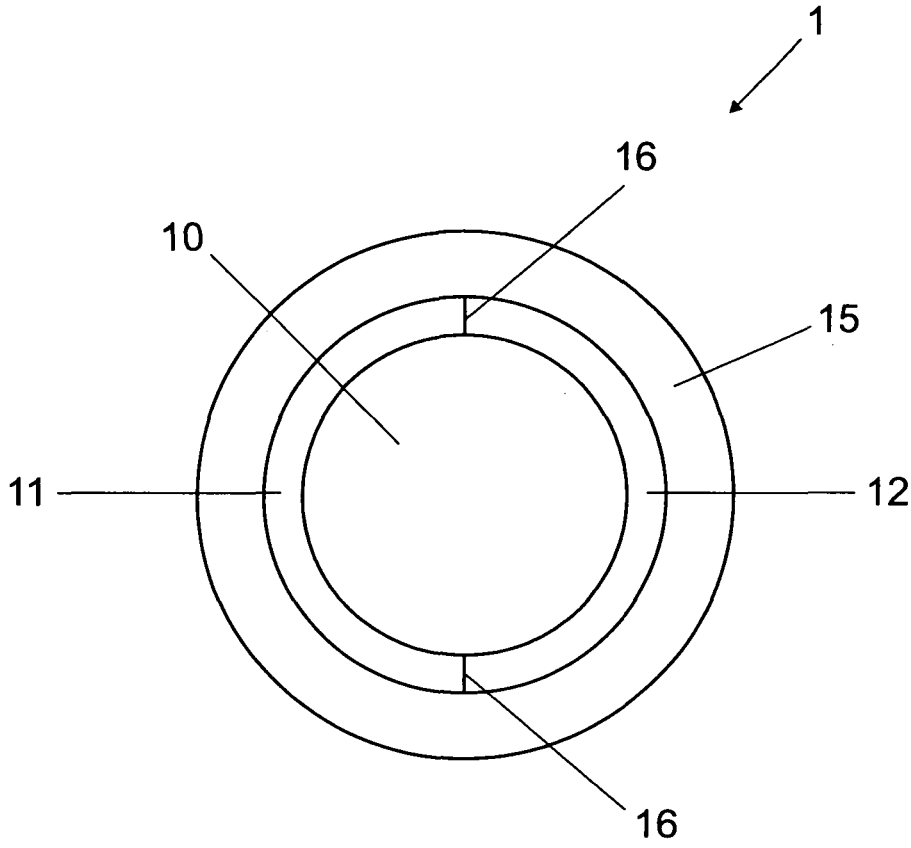
FIG. 2 shows the lighting device according to the invention as shown in FIG. 1, in a plan view.

FIG. 2 shows the lighting device of the invention according to FIG. 1 in a plan view. The fitted lamp 1 is fixed in the cladding panel 3 by means of a holding ring 15, which is part of the housing 4 of the fitted lamp 1, and on the one hand ensures the plane position of the fitted lamp 1 and therefore of the light exit surface 10 and on the other hand prevents the fitted lamp 1 from being inserted too far into the cladding panel 3. Arranged on either side of the light exit surface 10 are the ventilation openings 11, 12, which are separated from one another by a partition wall 16 so as to ensure a defined air flow from the air inlet opening 11 to the air outlet opening 12. The partition wall 16 is also used as a mounting for the optics unit 9 and the LED module 5, so that they are held reliably by means of the fan housing 14 and the partition wall 16 in the housing 4.

Figure 3:
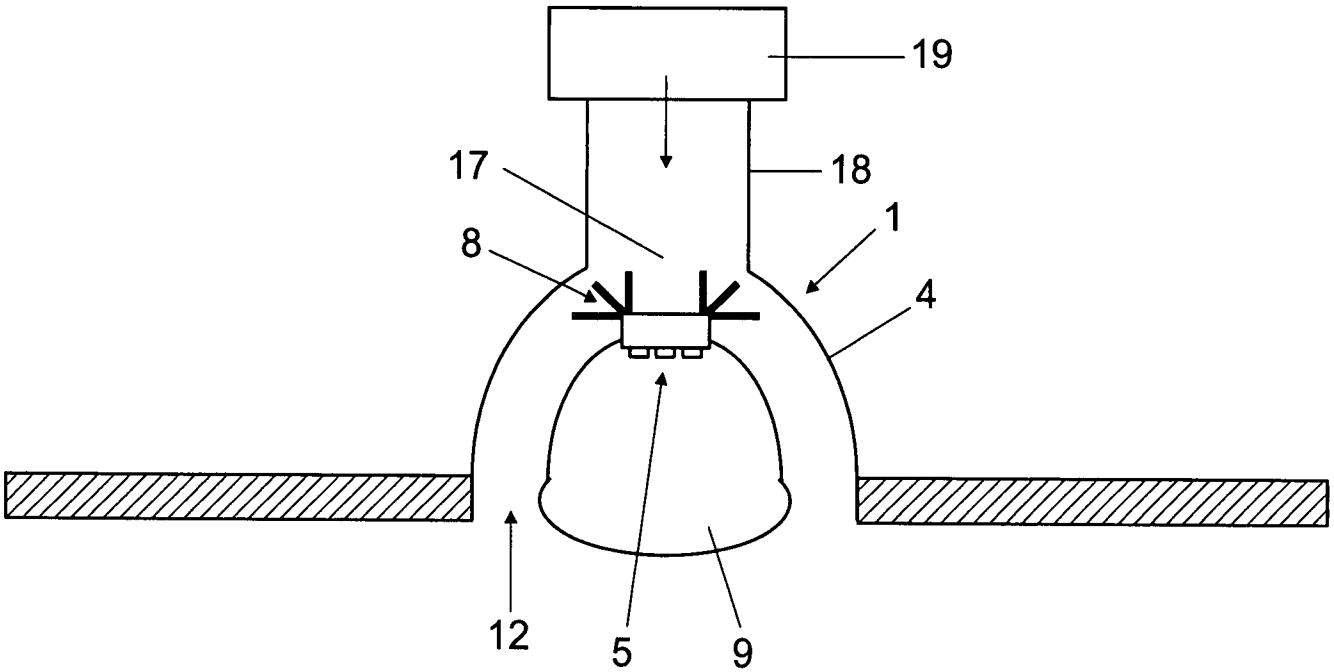
FIG. 3 shows another exemplary embodiment of the lighting device according to the invention with one fitted lamp.

Another embodiment of the invention is represented in FIG. 3, which shows a lighting device with one fitted lamp 1 represented in a lateral sectional view, in which the ventilation opening 12 is actively connected to a device for delivering air to and/or extracting air from the room to be illuminated.

The basic structure of the fitted lamp 1 corresponds to the previous exemplary embodiment, i.e. an LED module 5 and an optics unit 9 are arranged inside a bell-shaped housing 4. Here again, a heat sink 8 is arranged on the LED module 5. In contrast to the previous exemplary embodiment, however, the housing 4 has a ventilation opening 17 which is connected through a ventilation duct 18 to a device for delivering air to the room to be illuminated. The fresh air blown into the room by the device 19 flows past the LED module 5 and thereby cools it. Of course, the fitted lamp 1 may also be arranged in the intake flow of a device 19 for delivering air to the room to the illuminated so that the air extracted from the room flows through the fitted lamp 1. The latter is particularly advantageous when the intention is to prevent the room from being heated by the air blown in, while the air flow should be fed from the fitted lamp 1 into the room when the intention is to the heat the room. Depending on the application, it is therefore necessary to take into account the heating contribution due to the lighting device when configuring the device 19 for delivering air to the room to be illuminated. In contrast to the first exemplary embodiment, a fan 13 is not required inside the fitted lamps 1 in this embodiment, so that they can be made relatively small and the fan 13 does not cause any additional power consumption or noise. Furthermore, independent ventilation openings for delivering air to the room can be obviated in this way.

Figure 4:
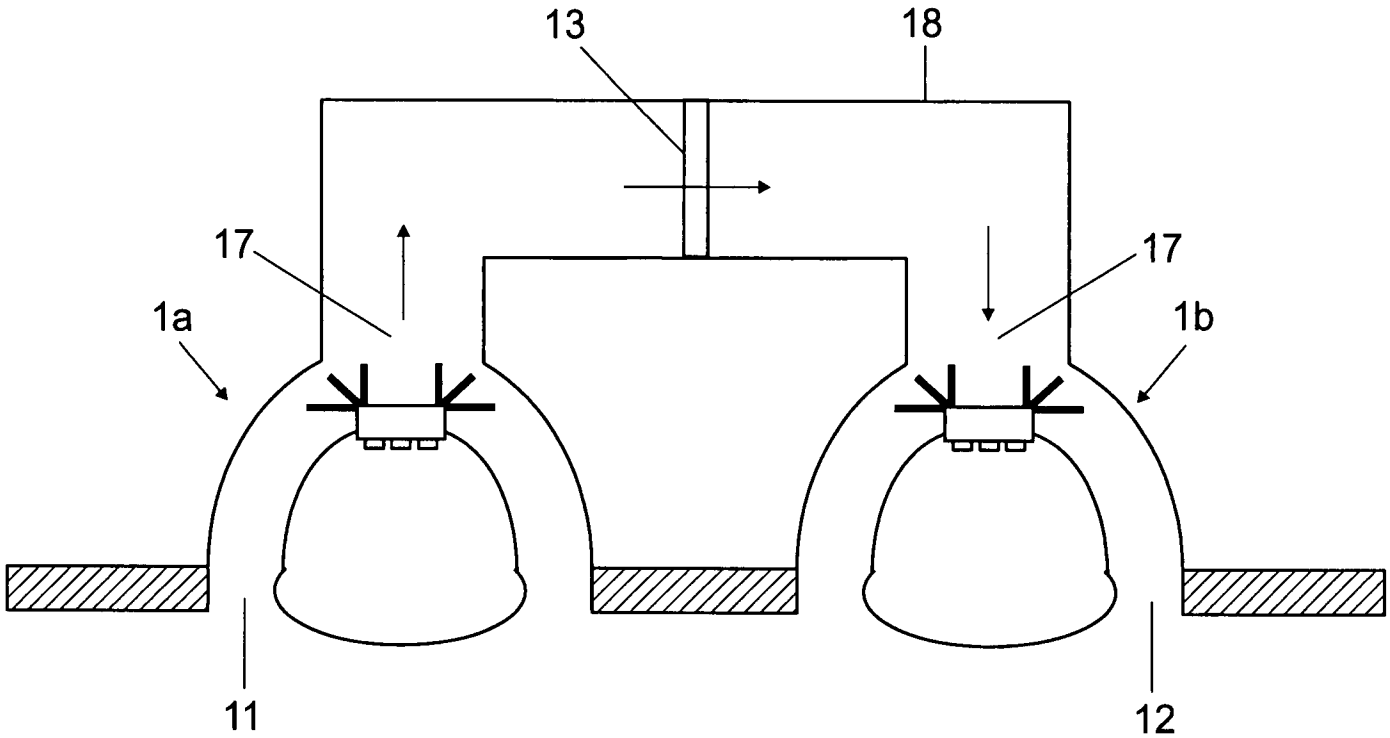
FIG. 4 shows another exemplary embodiment of the lighting device according to the invention with two fitted lamps.

FIG. 4 shows another exemplary embodiment of a lighting device according to the invention, in which two fitted lamps 1*a*, 1*b* are provided. These fitted lamps 1*a*, 1*b* correspond in their basic structure to the fitted lamp 1 shown in the previous exemplary embodiment, but the upper ventilation openings 17 of the two fitted lamps 1*a*, 1*b* are connected together by means of a ventilation duct 18. There is an electrically operated fan 13 inside the ventilation duct 18, so that the ventilation opening 11 in the first fitted lamp 1*a* is used as an air inlet opening 11 and the ventilation opening 12 in the second fitted lamp 1*b* is used as an air outlet opening 12. In this exemplary embodiment, the positioning of the fan 13 inside the lighting device is contingent on the installation conditions. In principle, the fan 13 may be arranged either inside a fitted lamp 1*a*, 1*b* or at any position inside the ventilation duct 18, and the chosen position may in particular be influenced to factors such as favorable connection to an electricity supply, easy access for repair work or minimizing the running noise.

Compared with the first exemplary embodiment, this embodiment is distinguished in that only one fan 13 is needed in order to cool a plurality of fitted lamps 1*a*, 1*b*, and with suitable placement it can also be operated more quietly and is more readily accessible than a component installed in a fixed fashion in a fitted lamp 1*a*, 1*b*. In contrast to the second exemplary embodiment, the placement of the fitted lamps 1*a*, 1*b* is not contingent on the possibilities of connection to the room air supply, and the strength of the air flow can also be controlled as a function of the cooling power required.

Of course, many other embodiments of the invention may be envisaged besides the exemplary embodiments shown.

Instead of the cylindrical design of the ventilation duct 18 as shown in the last two exemplary embodiments, this as well as the fitted lamps 1, 1*a*, 1*b* may of course also be shaped differently, particularly in order to save on installation space. For example, the ventilation duct 18 may be placed laterally on the fitted lamps 1, 1*a*, 1*b*, in which case the air inlet opening 11 and the air outlet opening 12 should expediently be placed on the side of the fitted lamp 1, 1*a*, 1*b* respectively facing away from the ventilation duct 18, in order to ensure that substantial parts of the air flow also travel past the LED module 5.

Of course, the ventilation duct 18 may also connect together more than two fitted lamps 1*a*, 1*b*. The cross-sectional size and shaping of the ventilation duct 18 will expediently be selected as a function of the requirements of the application in question.

For instance, embodiments may be envisaged in which, similarly as in the second exemplary embodiment, the air flow is fed at least partially through ventilation openings not integrated into a fitted lamp 1.

Depending on the place of use, it may for example be necessary to prevent dust and foreign bodies from entering with the air flow, so that for example a grille or filter may be arranged in the region of the inlet opening 11. Here, clogging of the filter may readily be avoided by reversing the direction of the air flow at suitable intervals, for example by changing the rotation direction of the fan 13. Since the outlet opening 12 becomes the inlet opening 11 in this case, it is recommendable to install a filter in front of all the ventilation openings.

Grilles which also cover the optics unit 9 at least partially, in order to protect it against damage, may also be envisaged.

The grille may for example be configured as a grille with holes, although a star shape may also be envisaged in particular for round fitted lamps, particularly when the grille is used as a mounting for the optics unit 9.

A similar configuration will be achieved if star-shaped partition walls are arranged between the individual ventilation openings 11, 12.

In the exemplary embodiments shown, the ventilation openings 11 and 12 essentially encircle the light exit surface 10 on all sides, although here again other embodiments may be envisaged, as described for the third exemplary embodiment.

The housing 4 of the fitted lamps 1, 1*a*, 1*b* may differ considerably in its shape from the shapes which have been shown; in particular, any other shape may be envisaged instead of a circular cross-sectional area of the light exit opening 10 as well as the housing 4, and particularly in the form of rectangular or oval cross sections.

The arrangement of the light exit surface 10 may also differ from that shown, for example by arranging it not parallel to the panel 3 but offset backward, which allows better protection against being touched.

The choice of the material and the manufacturing method for the housing 4 is likewise contingent on the requirements of the fitted lamp 1, 1*a*, 1*b*, so that it may for example be designed as a preferably deep-drawn metal part or as an injection-molded plastic part. It is likewise within the capacity of the person skilled in the art to select the type and arrangement of the LEDs 6 as well as the LED module 5, and in particular the shape and size of the heat sink 8.

All prior art devices known to the person skilled in the art may be envisaged for generating the air flow; when using a fan 13, it may be designed as a radial or axial fan.

The electrical layout of the lighting device may also differ from the exemplary embodiments shown. From example, the arrangement of the driver circuits for the LEDs 6 as well as the electricity supply for the electric fan 13 may be arranged outside the fitted lamps 1, 1*a*, 1*b*, so that only one electrical lead extends to the fitted lamps 1, 1*a*, 1*b* and fans 13 and no electrical components, or only subordinate electrical components, are arranged there in addition to the LEDs 6 or fan motors. Temperature-dependent operation of the fan 13 may also be envisaged, for example by installing a temperature sensor in the region of the LEDs 6 or the fitted lamp housing 4. Particularly in a system with more than two fitted lamps 1*a*, 1*b*, which are connected together through ventilation ducts 18, by controlling the air flow between the individual fitted lamps 1*a*, 1*b*, for example by operating individual fans 13, the distribution of the cooling air can be controlled and the cooling of the individual fitted lamps 1*a*, 1*b* can thus be optimized.

The invention claimed is:

1. A lighting device to be installed to at least one of a ceiling and a wall panel (3), the lighting device comprising:

at least one fitted lamp (1, 1*a*, 1*b*) having at least one housing (4) which ends approximately flush with the panel (3); and at least one light exit surface (10) and at least one LED module (5), the LED module (5) comprising at least one light-emitting diode (LED) (6);

wherein:

at least one ventilation opening (11, 12) is arranged between the light exit surface (10) and the housing (4);

means including a fan (13) are provided for generating an air flow through the ventilation opening (11, 12) to cool the LED module (5); and the fan (13) supports the LED module (5).

2. The lighting device as claimed in claim 1, wherein the light exit surface (10) is essentially encircled fully by one or more ventilation openings (11, 12).

3. The lighting device as claimed in claim 1, wherein the fitted lamp (1) has at least two ventilation openings (11, 12), of which at least one is designed as an air inlet opening (11) and at least one is designed as an air outlet opening (12).

4. The lighting device as claimed in claim 1, wherein the housing (4) of the fitted lamp (1) has a bell shape.

5. The lighting device as claimed in claim 1, wherein the housing (4) has thermal insulation.

* * * * *